US005791952A

United States Patent [19]

Trinkl

[11] Patent Number: 5,791,952

[45] Date of Patent: Aug. 11, 1998

[54] APPARATUS FOR DIRECTING BOAT EXHAUST FUMES

[75] Inventor: Robert E. Trinkl, Greendale, Wis.

[73] Assignee: Outboard Marine Corporation, Waukegan, Ill.

[21] Appl. No.: 724,647

[22] Filed: Oct. 1, 1996

[51] Int. Cl.[6] ..... B63H 21/32

[52] U.S. Cl. ..... 440/89; 114/211; 114/343

[58] Field of Search ..... 296/91; 114/67 A, 114/67 R, 211, 289, 270, 343; 440/89, 113

[56] References Cited

U.S. PATENT DOCUMENTS

| | | | |
|---|---|---|---|
| 1,412,848 | 4/1922 | Dunajeff | 114/289 |
| 4,339,145 | 7/1982 | Bott et al. | 296/91 |
| 4,991,532 | 2/1991 | Locke | 114/211 |

FOREIGN PATENT DOCUMENTS

| | | | |
|---|---|---|---|
| 2614261 | 10/1988 | France | 114/67 A |

*Primary Examiner*—Ed L. Swinehart

*Attorney, Agent, or Firm*—Jones, Day, Reavis & Pogue

[57] ABSTRACT

A method and apparatus for preventing exhaust fumes from entering the deck area of a motor boat having an engine of the type which has an exhaust port that expels fumes at the rear end of the boat is disclosed. The present invention includes an air manifold located at the rear end of the boat above the exhaust port and adapted to direct air to the rear of the boat. Air ducts having inlets located forwardly of the rear end of the boat are connected to the air manifold. The air manifold assembly is configured to form an air barrier between exhaust fumes and the rear deck area of the boat to prevent exhaust fumes from flowing into the rear deck or the cabin area.

18 Claims, 7 Drawing Sheets

Fig. 5
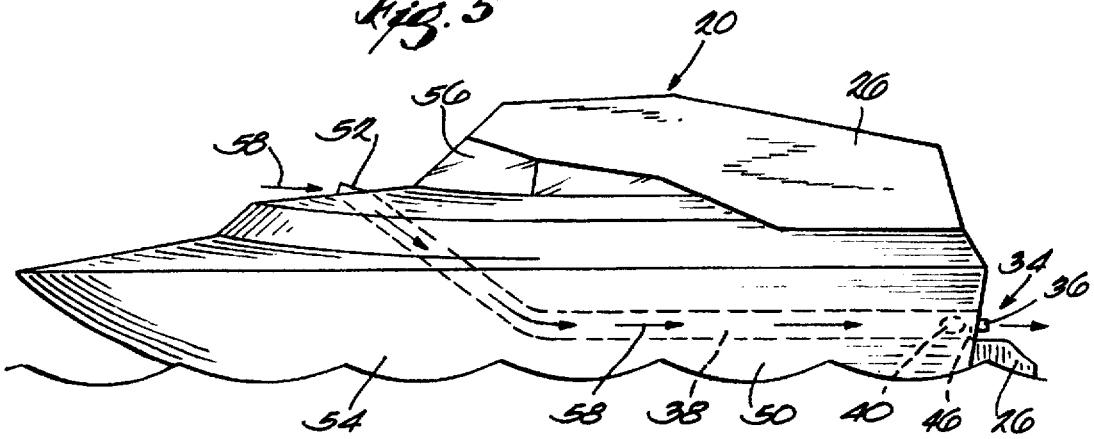
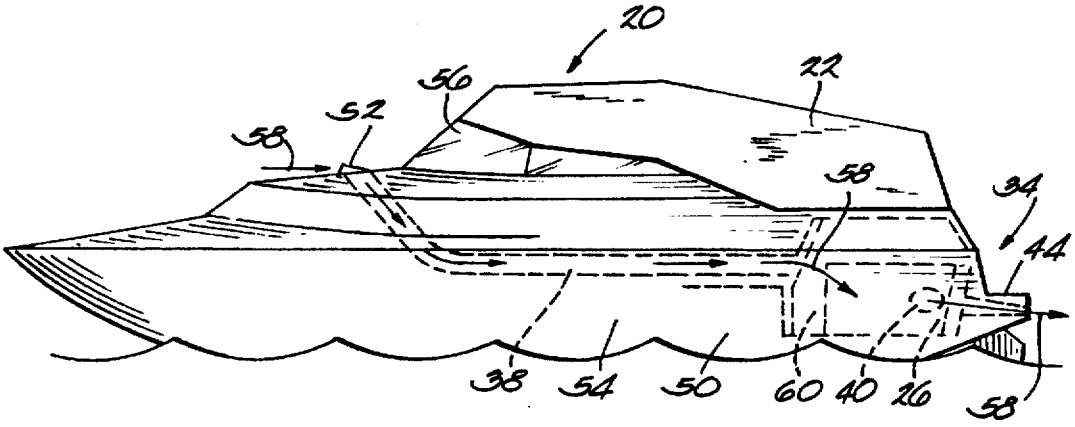
Fig. 6

Fig. 7
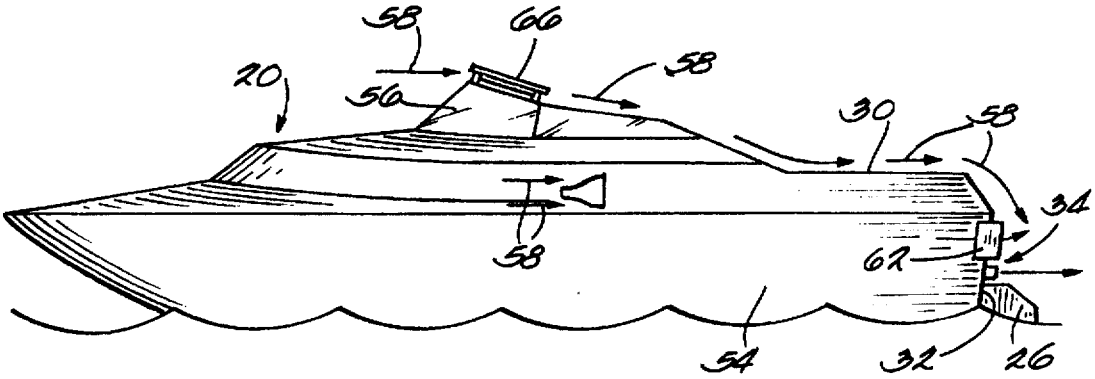
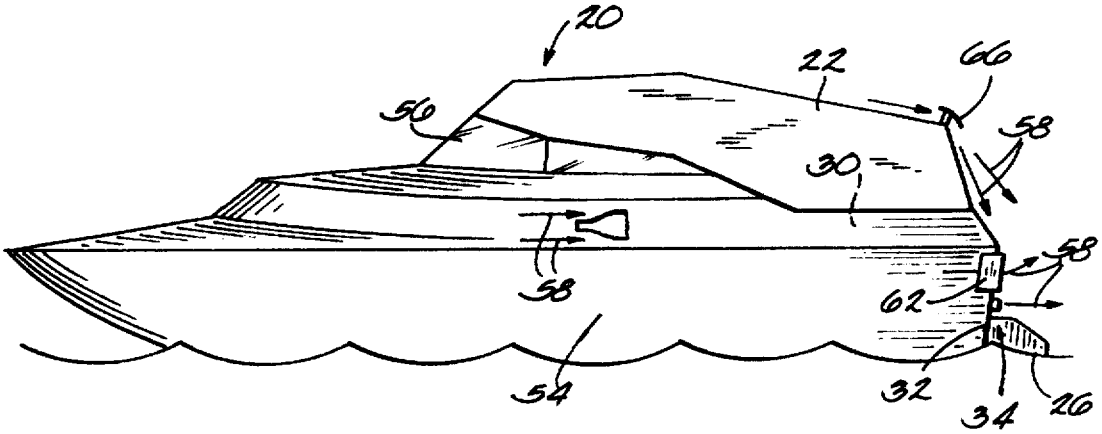
Fig. 8

APPARATUS FOR DIRECTING BOAT EXHAUST FUMES

This invention relates to an apparatus for preventing exhaust fumes produced at the stem of a motor boat from entering the rear deck area of the boat, and more particularly, to an apparatus which forms an air barrier between the rear deck and the exhaust port(s) to reduce a low pressure condition being created in the rear deck area and to push fumes away from the boat.

BACKGROUND OF THE INVENTION

Many conventional motor boats having a stemdrive engine produce exhaust fumes from exhaust ports that extend from a stem. Similarly, those having an outboard engine produce exhaust fumes that bubble up from water immediately behind the stem. As the boat moves forward, exhaust fumes have a tendency to drift over the transom and into a rear deck or a cabin area. As a result, the level of harmful fumes, e.g., carbon monoxide, gasoline and diesel fumes, etc., in the boat are greatly increased. Exhaust fumes have an unpleasant odor which not only cause discomfort to the boaters, but also expose them to dangerous carbon monoxide.

This exhaust fume problem arises from the general shape of the stem of many conventional boats. Such boats have a square or box-like stem, and as the boat moves forward, a low pressure area is created in the rear deck area of the boat. As a result, a curling or a "station wagon" effect occurs, which pulls exhaust fumes over the transom and into the rear deck area. Exhaust fumes can also drift into the rear deck area by ambient wind current when the boat is merely idling in place or going in reverse.

The harmful effects of exhaust fumes are of greater concern when the boat is moving at a low speed, e.g., when traveling in a restricted area such as a boat channel or a river. This is because fumes linger for a longer period in the rear deck area and are not dissipated by ambient wind as when the boat is moving at a faster speed. Exhaust fumes are also of greater concern in motor boats that have a cabin compartment enclosing the rear deck area, because harmful fumes flow into and get trapped in the cabin compartment with the boaters. Thus, there is a need for an apparatus for preventing exhaust fumes from flowing into the rear deck area or the cabin compartment of motor boats, regardless of whether the boat is traveling slowly, fast, in reverse or is idling.

Accordingly, one object of this invention is to provide an improved apparatus for preventing motor boat exhaust fumes from migrating into a rear deck area of a boat.

Another object is to provide an improved apparatus for preventing motor boat exhaust fumes from entering the rear deck area of a boat by forming an air barrier between the exhaust fumes and the rear deck area.

Yet another object is to provide an improved apparatus for preventing boat exhaust fumes from entering the rear deck area when the boat is idling, going in reverse or traveling at low or high speeds.

Still another object is to provide an improved apparatus for preventing boat exhaust fumes from entering the rear deck area that can be built into the motor boat at the time of manufacture or can be configured to be attached to the boat after its original manufacture.

These and other objects will become apparent upon reading the following detailed description of the present invention, while referring to the attached drawings, in which:

BRIEF DESCRIPTION OF THE DRAWINGS

FIG. 5 is a side view showing ambient air being directed through air ducts inside the boat, which are a part of the present invention;

FIG. 6 is a side view showing ambient air being directed through the air ducts and into an engine compartment, also embodying the present invention;

FIG. 7 is a side view of a square-stem boat shown with another embodiment of the apparatus of the present invention;

FIG. 8 is a side view of a square-stern boat having a rear curtain shown with the embodiment of the apparatus shown in FIG. 7;

DETAILED DESCRIPTION

The present invention is particularly adapted for use with a motor boat of the type that has a square stem and an engine, such as a sterndrive or an outboard, having an exhaust port that discharges fumes at the rear end of the boat. The boats having this configuration often develop a low pressure area in a rear deck area of the boat, which pulls exhaust fumes into the rear deck area or a cabin compartment. The present invention directs air to the rear end of the boat to create an air curtain above the exhaust port. The air curtain pushes exhaust fumes away from the boat and reduces the low pressure area, thus minimizing, if not preventing, exhaust fumes from entering the boat.

Broadly stated, the apparatus of the present invention includes air ducts having inlets located forwardly of the rear end of the boat, and an air manifold connected to the air ducts. The air manifold is located at the rear end of the boat above the exhaust port and adapted to direct air rearwardly of the boat. It is configured to form an air barrier between the boat exhaust fumes and the rear deck area of the boat to prevent exhaust fumes from flowing into the rear deck or the cabin area.

Further, a method is described for preventing boat exhaust fumes from entering a boat, whereby air is drawn from air ducts having inlets located forwardly of the rear end of the boat. The air is then expelled out of the air manifold to form an air barrier between the exhaust fumes and the rear deck so that the exhaust fumes are prevented from flowing into the rear deck area.

Figure 1:
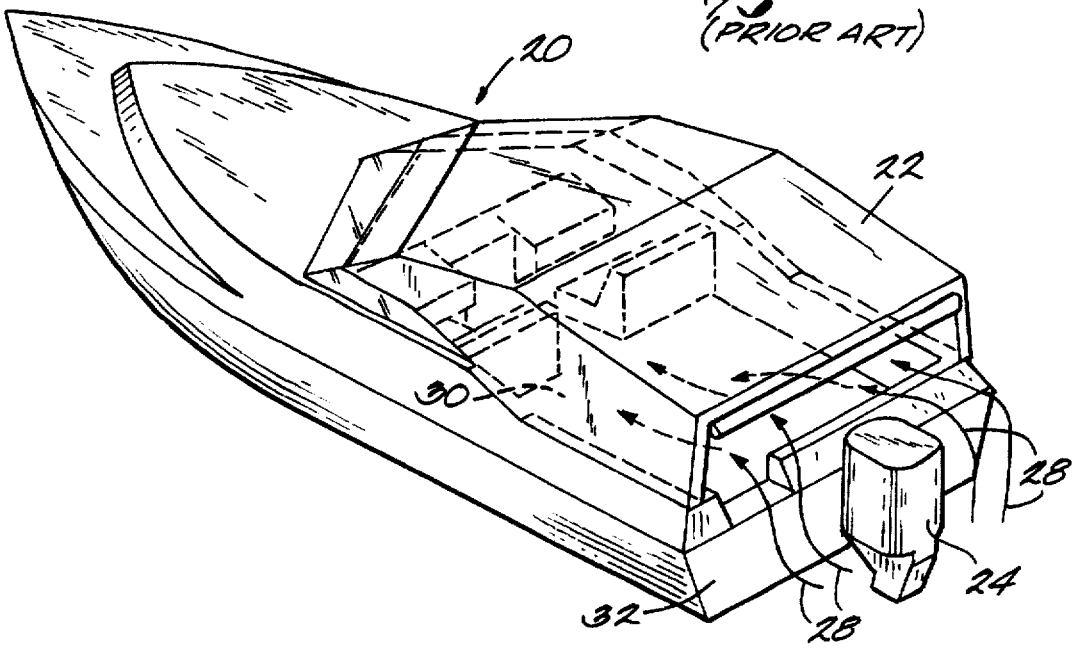
Fig. 1 (PRIOR ART)
FIG. 1 is a perspective view showing the path of exhaust fumes into a prior art boat having a square stem, an outboard engine and a rear curtain.
Figure 2:
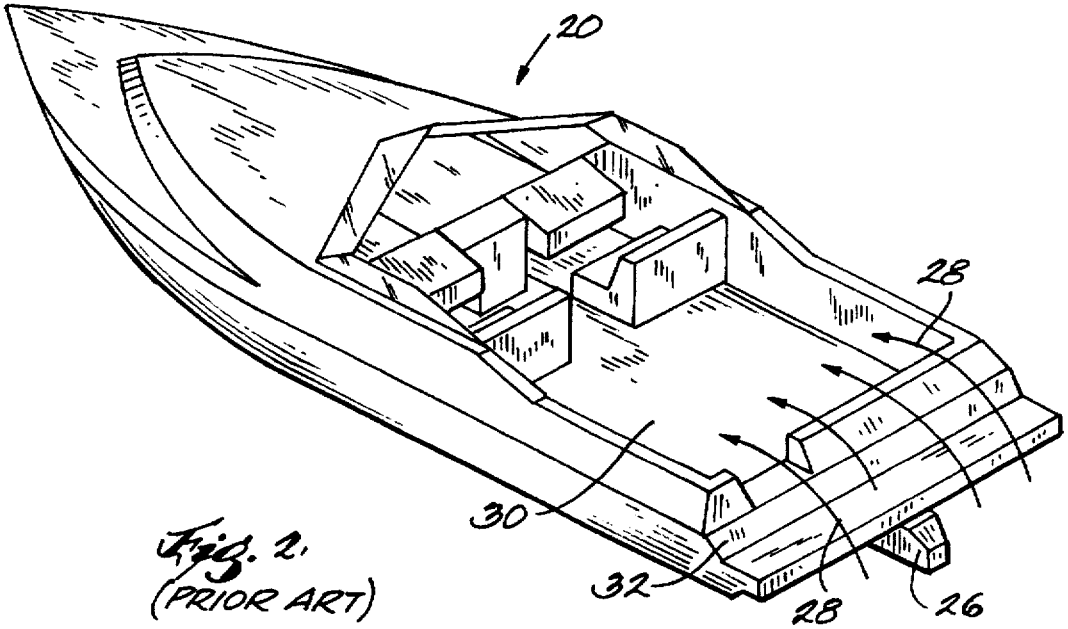
Fig. 2. (PRIOR ART)
FIG. 2 is a perspective view showing the path of exhaust fumes into a prior art boat having a square stem, a stemdrive engine but without a rear curtain.

Turning now to the drawings, and particularly FIGS. 1 and 2, a conventional square stem boat, indicated generally at 20, is shown with and without a rear curtain 22, respectively. FIG. 1 has an outboard engine 24 and FIG. 2 has a stem drive engine 26. When exhaust fumes are produced, the fumes flow generally in the manner shown by flow lines 28 into a rear deck area 30. This phenomenon results from a low pressure area that develops in the rear deck area 30 as the boat 20 moves forward. The low pressure area causes a curling or a "station wagon"effect, which pulls the exhaust fumes produced at a stern 32 into the rear deck area 30. Exhaust fumes may also drift into the boat 20 with the ambient wind even when the boat 20 is merely idling in place.

Figure 3:
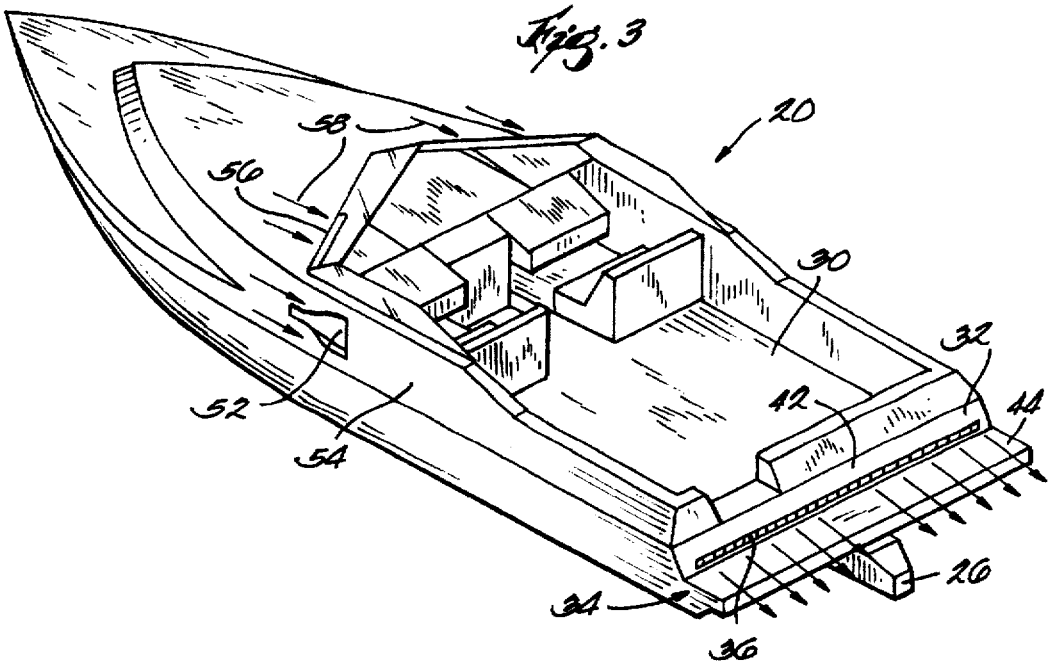
FIG. 3 is a perspective view of a square-stern boat having a stemdrive engine shown with an apparatus embodying the present invention.
Figure 4:
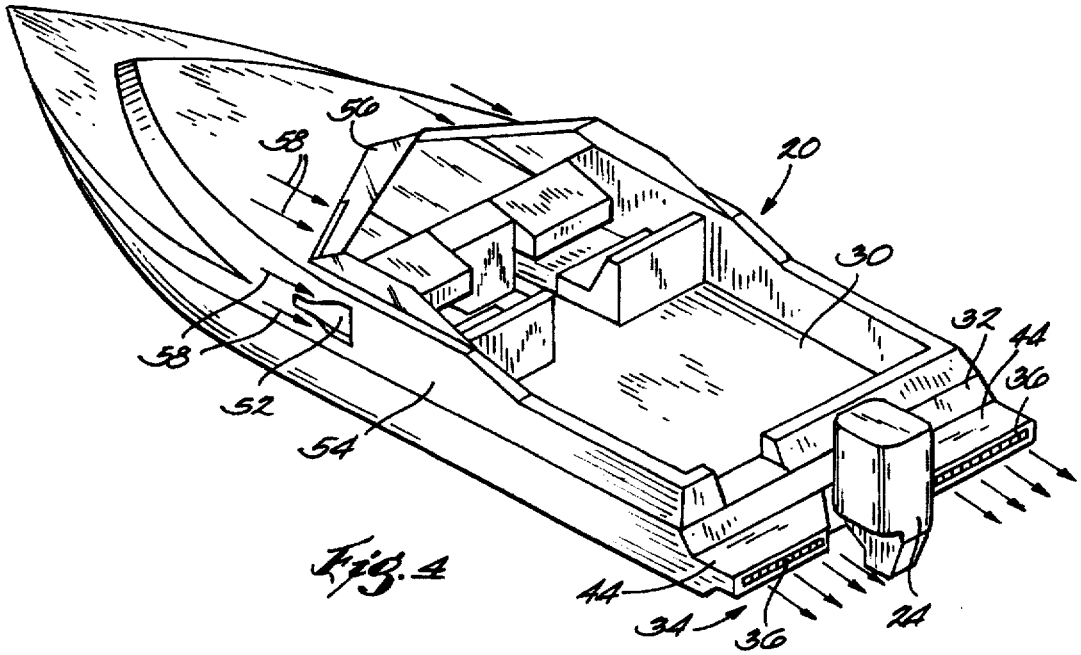
FIG. 4 is a perspective view of a square-stern boat having an outboard engine shown with the apparatus embodying the present invention.

As is shown in FIGS. 3 and 4, and which will be more comprehensively described, an apparatus of the present invention includes an air manifold assembly 34, which is located at the stern 32 of the boat 20. The air manifold assembly 34 is adapted to direct air to the stern 32 of the boat 20 to form an air barrier between the rear deck 30 and the exhaust port(s) to prevent exhaust fumes from entering the rear deck area 30.

In accordance with an important aspect of the present invention, the construction of the air manifold assembly 34 is illustrated in FIGS. 3–6. The air manifold assembly 34 includes a plenum 36, air ducts 38 and blowers 40. As shown in the embodiment of FIG. 3, the plenum 36 extends continuously and substantially across the width of the boat 20. The plenum 36 can also be separated into two pieces to accommodate the outboard engine 24, as shown in FIG. 5. The plenum 36 can either have slots running its entire length or it can also be perforated as shown in FIGS. 3 and 4, respectively. As shown in FIG. 3, the plenum 36 is preferably molded into a transom 42, but it can also be built into a swim platform 44, as shown in FIG. 4. Alternatively, the plenum 36 can also be mounted on the transom 42 (not shown) by any conventional mounting methods using, for example, screws or bolts.

While the plenum 36 is shown and described as having various configurations and attachment locations, it should be understood that it is important to place the plenum 36 on the stern 32 of the boat 20 above the exhaust port(s), which is generally at or below the waterline, to prevent exhaust fumes from entering the rear deck area 30. Additionally, the plenum 36 should be adjustable so as to position the air barrier formed above the exhaust port(s) to an optimal position. In other words, the plenum 36 should be capable of changing the direction of the air being expelled therefrom so that the air barrier can be moved up and down, and/or side to side.

As best shown in FIG. 5, the plenum 36 is connected to outlets 46 of the air ducts 38 running within side hulls 50 (only one side shown). The air ducts 38 have inlets 52 located on each side 54 of the boat 20 near a windshield 56 to draw outside air into the air ducts 38, as shown in FIGS. 3 and 4. The inlets 52 can also be located forward of the windshield 56, as shown in FIGS. 5 and 6. As shown by airflow lines 58, the outside air drawn in through the inlets 52 is directed through the air ducts 38 to the outlet 46 and then expelled out through the plenum 36.

The blowers 40 are included in the air manifold assembly 34 to assist in expelling air through the plenum 36. In the boat 20 having the outboard engine 24, the blowers 40 can be located in each air duct 38 near the plenum 36, as shown in FIG. 7, or near the inlet 52 (not shown). The blowers 40 are electrically operated by a toggle switch located on the dash board (not shown). This arrangement allows the operator to switch off the blowers 40 when they are not needed, as when the boat 20 is traveling at higher rates of speed, which correspondingly increase the velocity of the air flowing through the air ducts 38 and out the plenum 36.

As shown in FIG. 6, in the boat 20 having the stemdrive engine 26, the blowers 40 are housed within an engine compartment 60, which is interposed between the air ducts 38 and the plenum 36. In the engine compartment 60, the blowers 40 serve a dual purpose of not only expelling air through the plenum 36, but also discharging gasoline fumes from the engine compartment. In effect, the blowers 40 are essentially bilge exhaust blowers which have a capacity to move more air out of the engine compartment at a greater velocity than the conventional bilge exhaust blowers. Accordingly, the blowers 40 can be provided to replace the conventional bilge exhaust blowers at the time of manufacture, or the existing conventional bilge exhaust blowers can be modified to be or replaced by the blowers 40. This eliminates the need for a separate conventional bilge exhaust blowers.

In the preferred embodiment, two blowers 40 are provided in the engine compartment 60. The blowers 40 may be interlocked into the stermdrive engine 26 so that they run correspondingly with the engine or they can be made to stop running at a predetermined R.P.M. The blowers 40 can also be operated by a toggle switch (not shown) as in a conventional bilge exhaust blower. It should be understood that in an embodiment in which the blowers 40 are placed in the engine compartment 60, the cover of the engine compartment 60 should be gasketed to maintain a positive pressure therein.

As is shown in FIGS. 7 and 8, and which will be more comprehensively described, another embodiment of the present invention includes the air manifold assembly 34, a pair of side airfoils 62, 64 (only one side airfoil 62 is shown in FIGS. 7 and 8, see FIG. 9 for the other side airfoil 64), and a top airfoil 66. The description of the air manifold assembly 34 is described above, and will be omitted herein. The pair of side airfoils 62, 64 are attached to each side 54 of the boat 20 near the stern 32. The top airfoil 66 can be attached atop the windshield 56, as shown in FIG. 7, or atop the rear curtain 22, as shown in FIG. 8. As the boat 20 moves forward, these airfoils 62, 64, 66 direct ambient air to the rear of the boat 20 above the exhaust port(s) to prevent the fumes from entering the rear deck area 30, the velocity of the directed air increasing with the increase in the speed of the boat.

Figure 9:
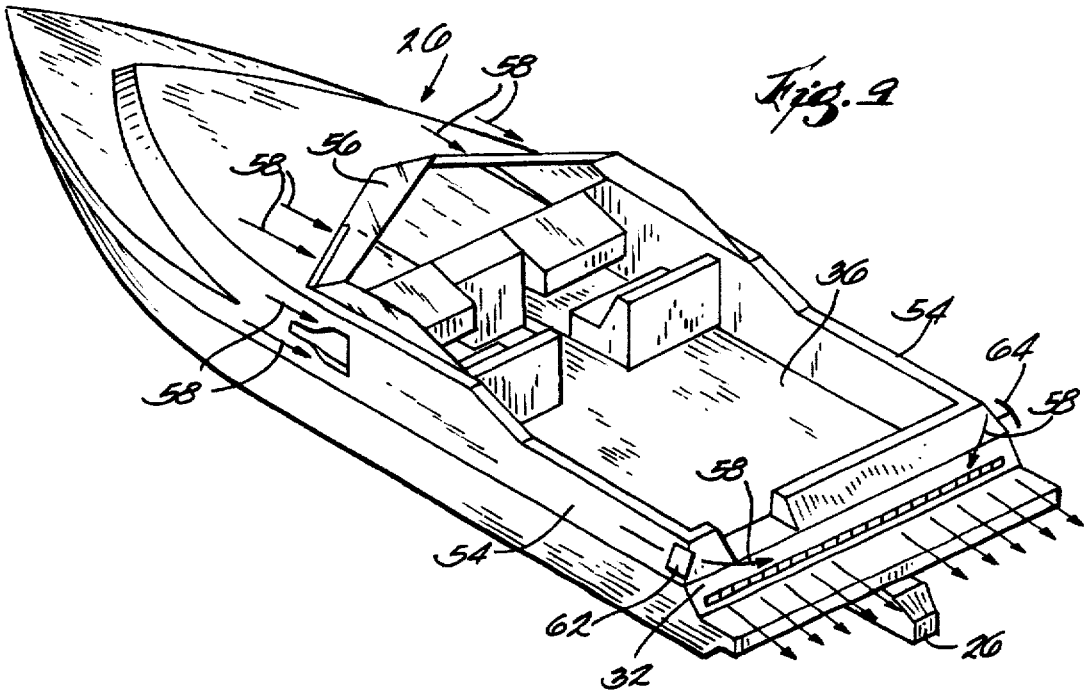
FIG. 9 is a perspective view showing side airfoils, which are a part of the embodiment shown in FIGS. 7 and 8 of the present invention.
Figure 10:
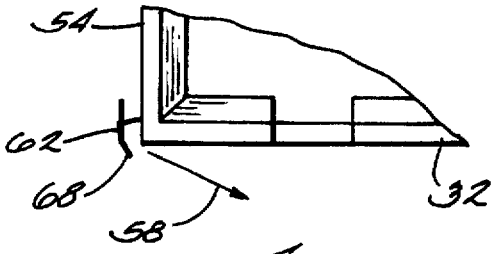
FIG. 10 is top view showing the configuration of the side airfoil shown in FIG. 9.
Figure 11:
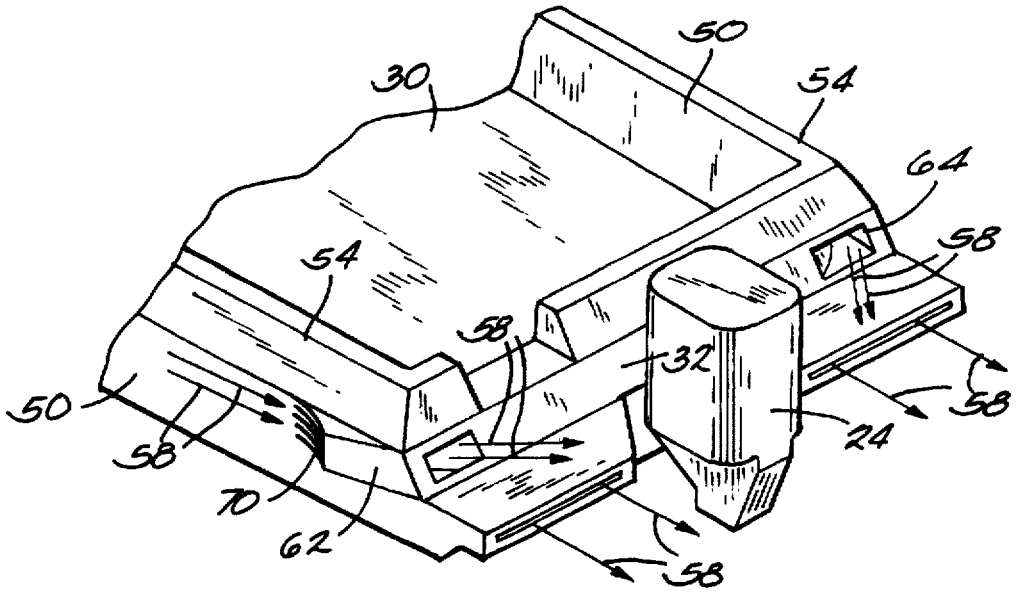
FIG. 11 is a perspective view showing another embodiment of the side airfoils.

In accordance with an important aspect of this embodiment of the present invention, the side airfoils 62, 64 are illustrated in greater detail in FIGS. 9–11. The side airfoils 62, 64 are attached to each side 54 of the boat 20 near the stem 32, as best shown in FIG. 9. A rear portion 68 of the side airfoils 62, 64 curves inward and toward the sterndrive engine 26 to catch and direct air rearwardly of the boat 20 (as the boat 20 moves in the forward direction), as shown by the airflow lines 58 in FIGS. 9 and 10. The side airfoils 62, 64 can be retrofitted onto currently existing boats 20, or they can be attached to the boat 20 during the boat manufacturing process.

Further, the side airfoils 62, 64 can also be configured into a built-in air scoop system. As shown in FIG. 11, the side airfoils 62, 64 are built into the side hulls 50 of the boat 20. A front portion 70 of the side airfoils 62, 64 take in outside air as the boat 20 moves forwardly, and direct air rearwardly, as illustrated by the airflow lines 58. Optionally, the side airfoils 62, 64 of this embodiment may be retractable so that they fold into the side hull 50 when they are not needed, as during docking, so that they are not damaged.

Figure 12:
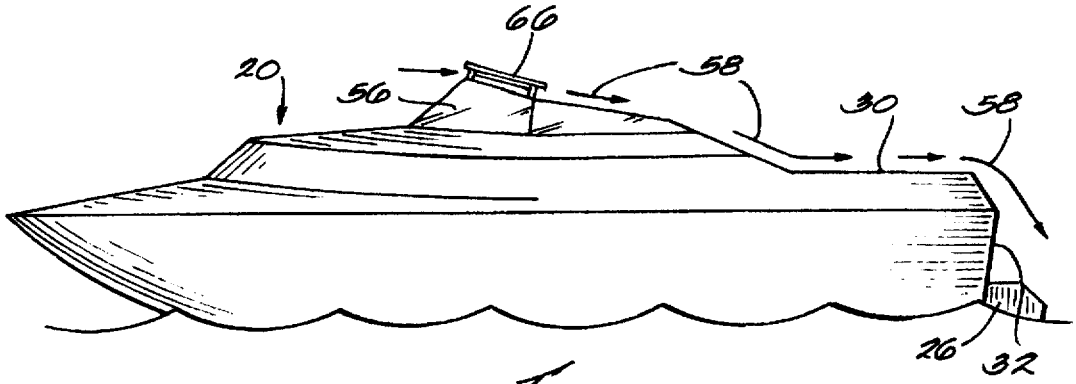
FIG. 12 is a side view showing a top airfoil, which is a part of the embodiment shown in FIGS. 7 and 8, attached atop a windshield.
Figure 13:
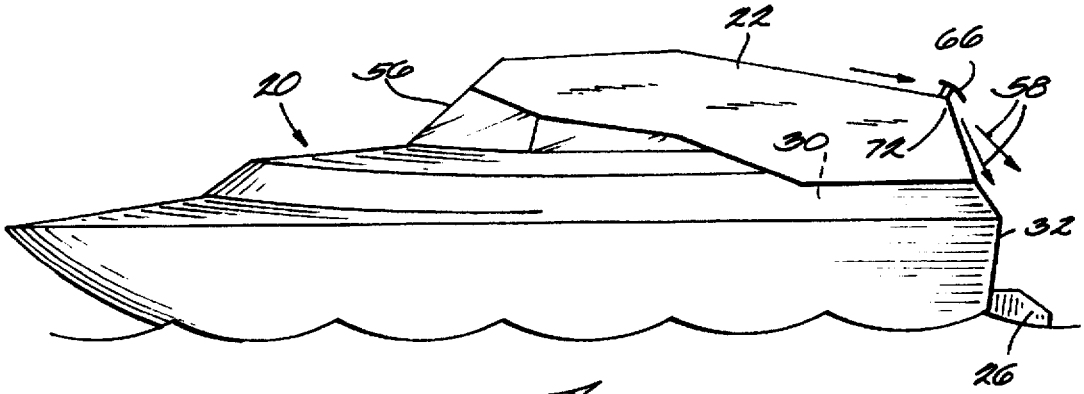
FIG. 13 is a side view showing the top airfoil attached atop a rear curtain.

In accordance with another important aspect this embodiment, the top airfoil 66 is shown in FIGS. 12 and 13. In the boat 20 without the rear curtain 22, the top airfoil 66 is be attached to the top of the windshield 56, as shown in FIG. 12. As the boat 20 moves in the forward direction, the top airfoil 66 directs air to the stem 32 of the boat 20. As shown by the air flow lines 58, the air closely follows the elevational contour of the boat 20, and when it reaches the stem 32, it flows downwardly to prevent exhaust fumes from entering the rear deck area 30. While the precise dimensions of the top airfoil 66 is not critical, its shape should be such that it is able to redirect air flowing above the windshield 42 to the stem 32.

FIG. 13 shows another embodiment of the top airfoil 66 of present invention, in which the top air foil 66 is attached to the rear curtain 22 at the rear portion 72 thereof. The top airfoil 66 directs air down and toward the rear of the boat 20, as shown by the airflow lines 58. Once again, the dimensions of the top airfoil 66, as in the embodiment in which top airfoil 66 is attached to the windshield 56, should be such that it is able to redirect air flowing above the rear curtain 22 to the stern 32. In this manner, exhaust fumes are pushed downwardly and away from the rear deck area 30 and the lower air pressure condition at the stem is reduced.

It should be understood that the side airfoils 62, 64 and the top airfoil 66 can operate independently of the air manifold assembly 34 or simultaneously therewith. For example, the side airfoils 62, 64 and the top airfoil 66 are most effective when the boat 20 is traveling at a high speed, and therefore the blowers 40 may be turned off. However, when the boat 20 is traveling at a slow speed or idling, the side and top airfoils 62, 64, 66 are not as effective, in which case the blowers 40 should be activated. Of course, the blowers 40 can also be left on continuously regardless of the boat speed without any adverse effect.

From the forgoing description, it should be understood that an improved apparatus for use in preventing boat exhaust fumes produced at the stem of a motor boat from entering the rear deck area of the boat has been shown and described, which has many advantages and desirable attributes. For example, exhaust fumes are prevented from entering the rear deck area regardless of whether the boat is traveling slowly, fast, in reverse or is idling. The apparatus can be built into the boat at the time of manufacture, or it can also be configured to be attached to the boat after its original manufacture, thus providing greater flexibility in installing the apparatus.

While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. Apparatus for use with a motor boat having an engine with an exhaust port which produces fumes at the rear end of the boat, said apparatus being adapted to prevent boat exhaust fumes from migrating into a rear deck area of the boat, said apparatus comprising:

an air duct having an inlet locatable forwardly of the rear end of a boat; and air manifold means connected to said air duct and locatable at a transom of a boat above an exhaust port, said air manifold means being adapted to direct air generally rearwardly of a boat to form an air barrier between boat exhaust fumes and a rear deck area of the boat, said air barrier preventing exhaust fumes from flowing into a rear deck area of a boat.

2. Apparatus as defined in claim 1 wherein said air manifold means is a plenum.

3. Apparatus as defined in claim 1 wherein said air manifold means is moldable into a transom of a boat.

4. Apparatus as defined in claim 1 wherein said air manifold means is imbedable into a swim platform of a boat.

5. Apparatus as defined in claim 1 wherein said air manifold means includes at least one slot extending above the exhaust port.

6. Apparatus as defined in claim 1 wherein said air manifold means includes a plurality of holes extending above the exhaust port.

7. Apparatus as defined in claim 1 wherein air manifold is configured to be adjustable to vary a direction of the air being directed.

8. Apparatus as defined in claim 1 further including means disposed within said air duct for moving air through said air duct to said air manifold means.

9. Apparatus as defined in claim 8 wherein said air moving comprises at least one blower.

10. Apparatus as defined in claim 1 further including means positionable within an engine compartment of a boat for moving air from said engine compartment to said air manifold means.

11. Apparatus as defined in claim 10 wherein said air moving means comprises at least one blower.

12. Apparatus for use with a motor boat having an engine with that has an exhaust port which produces fumes at the rear end of the boat, said apparatus being adapted to prevent boat exhaust fumes from migrating into a rear deck area of the boat, said apparatus comprising:

at least one airfoil means configured to be attached forwardly of the rear end of the boat to direct air to the rear end of the boat;

an air duct having an inlet located forwardly of the rear end of the boat; and air manifold means connected to said air duct and located at the rear of the boat above the exhaust port and being adapted to direct air generally rearwardly of the boat to form an air barrier between the boat exhaust fumes and the rear deck area of the boat, said air barrier and/or said air directed to the rear end of the boat by said airfoil means preventing the exhaust fumes from flowing into the rear deck area of the boat.

13. Apparatus as defined in claim 12 wherein said at least one airfoil means includes front airfoil means and a pair of side airfoils means.

14. Apparatus as defined in claim 13 wherein said front airfoil means is attachable to a windshield.

15. Apparatus as defined in claim 13 wherein said front airfoil means is attachable to a rear curtain of the boat.

16. Apparatus as defined in claim 12 wherein each of said pair of side airfoils means is attachable on either side of the boat near the rear end.

17. Apparatus as defined in claim 12 further including means disposed within said air duct for moving air through said air duct to said air manifold means.

18. Apparatus as defined in claim 12 further including on engine compartment interposed between said air duct and air manifold means, and means, housed in said engine compartment, for moving air from said engine compartment to said air manifold means.

* * * * *